United States Patent [19]

Köhnen et al.

[11] Patent Number: 4,590,867

[45] Date of Patent: May 27, 1986

[54] PIN FOR HOLDING AND/OR COOLING OF CERAMIC COATINGS IN HOT REACTION CHAMBERS

[75] Inventors: Klaus Köhnen, Mülheim; Norbert Ullrich, Essen, both of Fed. Rep. of Germany

[73] Assignee: Krupp-Koppers GmbH, Essen, Fed. Rep. of Germany

[21] Appl. No.: 741,259

[22] Filed: Jun. 4, 1985

Related U.S. Application Data

[63] Continuation of Ser. No. 572,922, Jan. 20, 1984, abandoned.

[30] Foreign Application Priority Data

Feb. 11, 1983 [DE] Fed. Rep. of Germany ..... 3304745

[51] Int. Cl.[4] ..... F23M 5/00

[52] U.S. Cl. ..... 110/336; 52/474; 52/761; 432/248

[58] Field of Search ..... 110/336; 52/474, 761, 52/765, 766; 432/247, 248

[56] References Cited

U.S. PATENT DOCUMENTS 3,652,251 3/1972 Brichard ..... 110/336 X 3,771,467 11/1973 Sweet ..... 110/336

*Primary Examiner*—Edward G. Favors

*Attorney, Agent, or Firm*—Michael J. Striker

[57] ABSTRACT

A pin for holding and/or cooling of a ceramic coating in hot reaction chambers has a pin shaft and a pin cap connected with one another in firm and heat-conductive manner, wherein the pin shaft is composed of material corresponding to the reaction conditions in the hot reaction chamber, and the pin cap is composed of a material corresponding to the material of the wall of the hot reaction chamber.

6 Claims, 1 Drawing Figure

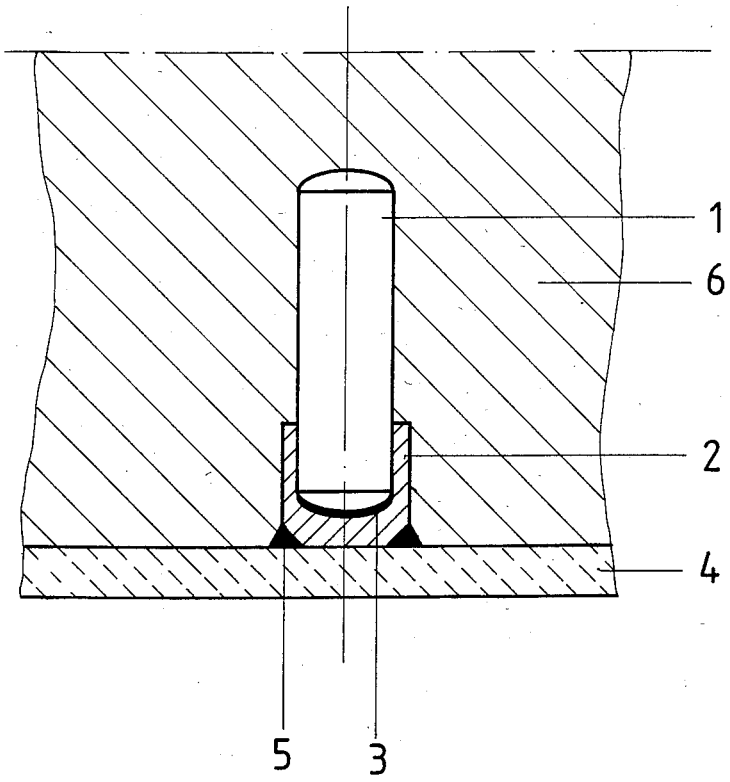
1
6
2
4
5
3

PIN FOR HOLDING AND/OR COOLING OF CERAMIC COATINGS IN HOT REACTION CHAMBERS

This is a continuation of application Ser. No. 572,922, filed Jan. 20, 1984, now abandoned.

BACKGROUND OF THE INVENTION

The present invention relates to a pin for holding and/or cooling of ceramic coatings in hot reaction chambers, particularly to a pin which is composed of two components.

In hot reaction chambers, such as for example in furnace chambers of coal gasifiers, high temperatures prevail which are required for the course of the desired reactions and/or for a liquid slag withdrawal. As a rule it is necessary here to provide the walls of the hot reaction chambers with a respective temperature-resistant ceramic coating. This coating which normally is formed as a ramming or spraying mass is applied on the walls of the hot reaction chambers and serves for protecting these walls from damage by the action of the high temperature and at the same time for providing the required heat insulation of the hot reaction chamber so as to reliably hold the desired high reaction temperatures inside the chamber. The walls of the hot reaction chambers can be naturally so-called tubular walls, when for example the hot reaction chamber is a melting chamber of a vaporizer or a reaction chamber of a coal pressure gasifier.

For holding and/or cooling the ceramic coating, the walls of the hot reaction chamber are normally provided with pins on which the ceramic coating is mounted. Aproximately two thousand pins are used per square meter of the coating. These pins were produced from non-alloyed steel. However, it has been shown that these pins, in conditions of high temperature acting in the hot reaction chambers, are oxidized and partially thinned by corrosion after relatively short operation times. Because of this, these pins were replaced by pins of high oxidation-resistant steels, for example chromium-aluminum steels. However, this causes another problem. In the event of welding of such pins with the wall of the hot reaction chambers, after a relatively short operation time an embrittling of these pins takes place, which leads to shapeless breakage of the pins at the pin foot. The new pin insertion and new coating of the walls of the hot reaction chambers, which is required after this, leads to considerable operational stoppages and expenditures. It has also been shown that by welding such pins with the wall of the hot reaction chambers, damage to the wall material is caused. This damage is reduced first of all to diffensions process and texture changes, for example decarbonization process, which is responsible for different material composition between the pin and the wall. This damage to the wall material increases naturally with each eventually required new pin introduction. In thin hot reactor chambers loaded in their interior, such as for example the tubular walls of coal pressure gasifiers, this can lead to a considerable reduction of the service life.

To eliminate these problems, it is known to make a compromise in the material selection. Based on this approach, pins are produced with relatively low alloy chromium steel which have a better corrosion and oxidation resistance as compared with the pins of non-alloyed steel, and also is not so heavily inclined to embrittling. Such a compromise is, however, unsatisfactory in many cases, particularly when in hot reaction chambers relatively high temperatures take place. It is also known to make a pin of two components, including a non-alloyed steel core and a sleeve of an oxidation-resistant material. The welding end of this pin is conical, so that the welding connection is first of all produced by the non-alloyed core material. The pin cap facing towards the hot reaction chamber is, however, not subjected to the reaction conditions in the hot reaction chamber without protection, so that at least the non-alloyed steel core of this pin is subjected to respective damages.

Finally, experiments have been conducted to use a pin which has a pin lower part of a non-alloyed steel and a pin upper part of an oxidation-resistant material arranged on the pin lower part and welded by straight welding seams. This pin does not, however, prove to be acceptable in practice, since as expected in the condition of high temperature a breakage in the welding connection between the pin upper part and the pin lower part occurs.

Since for the operability and effectiveness of a hot reaction chamber, the mounting of the ceramic coating which depends on the service life of the pins is of decisive importance, the solution of the above described problems has great practical importance.

SUMMARY OF THE INVENTION

Accordingly, it is an object of the present invention to provide a pin for holding and/or cooling the ceramic coating in hot reaction chambers, which avoids the disadvantages of the prior art.

More particularly, it is an object of the present invention to provide a pin for holding and/or cooling of the ceramic coating in hot reaction chambers, which has a high temperature-, corrosion-, erosion- and oxidation-resistance, on the one hand, and, on the other hand, can be welded in a durable manner with the wall of the hot reaction chamber without damaging the wall material.

It is also an object of the present invention to provide a pin of the above mentioned general type which can be produced in a simple and relatively cost-economical manner.

In keeping with these objects and with others which will become apparent hereinafter, one feature of the present invention resides, briefly stated, in a pin which has two components including a pin shaft of a temperature-, corrosion-, erosion- and oxidation-resistant material corresponding to reaction conditions in a hot reaction chamber, and a pin cap of a material corresponding to the material of the wall of the hot reaction chamber, wherein the pin shaft is inserted in the pin head and has the respective dimensions, and both parts are connected with one another in a firm and heat-conductive manner.

When the pin is designed in accordance with the invention, it eliminates the disadvantages of the prior art and provides for the above mentioned advantageous results.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a view showing a pin for holding and/or cooling of a ceramic coating in hot reaction chambers, in accordance with the present invention.

DESCRIPTION OF A PREFERRED EMBODIMENT

A pin in accordance with the present invention has a pin shaft which is identified with reference numeral 1 and a pin cap which is identified with reference numeral 2. The pin shaft 1 is fitted in the pin cap 2. Both parts are connected with one another in a firm and heat-conductive manner. The connection of the pin shaft 1 and the pin cap 2 can be performed either during production of the pin, or during welding of the same on the wall 4 of the hot reaction chamber. For example, the pin shaft 1 and the pin cap 2 can be connected with one another by shrinking-on, screwing or resistance welding. Another possibility of connecting the pin shaft 1 with the pin cap 2 in firm and heat-conductive manner is to perform this by a homogeneous material connection 3, for example with a cement suitable for this purpose.

The pin is embedded in a ceramic coating 6 which is obtained because of it the required hold. In accordance with the invention, the pin shaft 1 is composed of a material which under the respective conditions of the hot reaction chamber is temperature-, corrosion-, erosion- and oxidation-resistant, for example chromium-aluminum steel. The pin cap 2 is composed, to the contrary, of a material corresponding to the material of the wall 4 of the hot reaction chamber, or in other words of the similar material, so that in the case of welding of the pin cap 2 and the wall 4 no embrittling problems and no damages to the wall material can take place. The welding is performed similarly to the conventional pins in accordance with accepted methods, for example by arc welding. The welding seam is identified in the drawing with reference numeral 5.

A distinctive advantage of the inventive pin is that it is acceptable for the suitable material combination for the pin shaft 1 and the pin cap 2, so that the construction of the pin because of an individual material section can exactly correspond to the predetermined process and efficiency requirements. Because of a relatively high number of pins which are required per square meter of the ceramic coating, the satisfaction of these requirements has a considerable practical significance. With the formation of the pin cap 2 so that the pin shaft 1 is firmly fitted into it, a breakage of the pin shaft 1 under the action of shearing and bending forces is prevented. Simultaneously, via the pin cap 2, a reliable welding connection with the wall 4 of the hot reaction chamber can be provided. The inventive pin shows an extraordinarily high service life.

It is to be understood that the formation of the pin shaft 1 and the pin cap 2 can also deviate from that shown in the drawing. Particularly, the pin cap 2 can have inclined inner surfaces and the pin shaft 1 can have corresponding outer surface. Furthermore, the wall thickness of the pin cap 2 can naturally be dimensioned so that it corresponds to the requirements of the respective connecting method between the pin cap 2 and the wall 4, as well as between the pin shaft 1 and the pin cap 2.

It will be understood that each of the elements described above, or two or more together, may also find a useful application in other types of constructions differing from the types described above.

While the invention has been illustrated and described as embodied in a pin for holding and/or cooling the ceramic coating in a hot reaction chamber, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various modifications and structural changes without departing in any way from the generic or specific aspects of the present invention.

What is claimed as new and desired to be protected by Letters Patent is set forth in the appended claims:

1. A hot reaction chamber, comprising a wall; a ceramic coating held on said wall in gapless surface contact therewith; and a pin for holding and cooling a ceramic coating, said pin including a pin shaft composed of a material which is temperature-, corrosion-, erosion- and oxidation-resistant in reaction conditions in a hot reaction chamber and extending into the interior of said ceramic coating; and a pin cap composed of a material corresponding to the material of a wall of the hot reaction chamber and arranged on said wall in gapless surface contact therewith, said pin shaft being fitted in said pin cap and connected with said pin cap in non-releasable form-locking manner in direct surface contact with the latter in a firm and heat-conductive manner so that the pin can, not only hold the ceramic coating, but also cool the ceramic coating.

2. A hot reaction chamber as defined in claim 1, wherein said pin shaft and said pin cap are connected with one another by shrinking-on.

3. A hot reaction chamber as defined in claim 1, wherein said pin shaft and said pin cap are connected with one another by resistance welding.

4. A hot reaction chamber as defined in claim 1, wherein said pin shaft and said pin cap are connected with one another by homogeneous material connection.

5. A pin as defined in claim 4, wherein said homogeneous connection of said pin shaft and said pin cap includes a connection with the aid of a cement.

6. A hot reaction chamber as defined in claim 1, wherein said pin cap and the wall of the hot reaction chamber, as well as said pin shaft and said pin cap, are connected with one another by respective connecting methods, said pin cap having a thickness corresponding to the requirement made to said connecting methods.

* * * * *